US005269890A

United States Patent [19]

Marchywka

[11] Patent Number: 5,269,890

[45] Date of Patent: Dec. 14, 1993

[54] ELECTROCHEMICAL PROCESS AND PRODUCT THEREFROM

[75] Inventor: Michael J. Marchywka, Lanham

[73] Assignee: The United States of America as represented by the Secretary of the Navy, Washington, D.C.

[21] Appl. No.: 999,629

[22] Filed: Dec. 31, 1992

[51] Int. Cl.[5] ..... C25F 5/00

[52] U.S. Cl. ..... 204/146

[58] Field of Search ..... 204/146

[56] References Cited

FOREIGN PATENT DOCUMENTS 188300 8/1991 Japan .

*Primary Examiner*—T. Tufariello

*Attorney, Agent, or Firm*—Thomas E. McDonnell; George A. Kap

[57] ABSTRACT

Removal of non-diamond carbon from a diamond substrate surface is accomplished in an electrochemical apparatus comprising an electrolyte and spaced electrodes immersed in the electrolyte and having impressed voltage producing a sufficient electric field in the electrolyte to remove at least a portion of the non-diamond carbon. Removal of the non-diamond carbon is accomplished by disposing the substrate in the electrolyte without touching the electrodes for a time sufficient to dislodge at least a portion of the non-diamond carbon. The invention herein is also directed to diamond substrates having non-diamond carbon with a high resolution on its surface.

20 Claims, 2 Drawing Sheets

ELECTROCHEMICAL PROCESS AND PRODUCT THEREFROM

FIELD OF INVENTION

This invention pertains generally to an electrochemical process and product and particularly to electrochemical removal of non-diamond carbon.

BACKGROUND OF THE INVENTION

Removal of non-diamond carbon from a surface of a substrate has been accomplished in the past by wet chemical etching and by reactive ion etching.

Wet chemical etches cannot be masked with a photoresist since such etches also attack the known photoresists even more quickly than the non-diamond carbon. In order to use a wet chemical etch to pattern a non-diamond carbon layer, all non-diamond carbon must be either removed or portions thereof masked with an inert substance like silicon dioxide, which is difficult to do because wet chemical etches, such as boiling chromic acid-sulfuric acid mixtures, are non-selective chemicals and are difficult to work with.

Reactive ion etching or ion beam assisted etching produce energetic ions which can be used to selectively remove portions of non-diamond carbon down to the substrate surface. This is done by placing a mask or a metal pattern on a layer of non-diamond carbon disposed on a substrate and directing the energetic ions at the non-diamond carbon on the substrate. Removal of the exposed non-diamond carbon is facilitated by the energetic ions. The use of energetic ions to selectively remove non-diamond carbon results in damage to the underlying substrate surface making it less useful for electronic applications.

Partial removal of non-diamond carbon is usually used to form patterns of non-diamond carbon on a substrate. This result can be achieved with ion beam implantation. Pursuant to this procedure, a metal shadow mask is placed over a substrate devoid of non-diamond carbon thereon and then carbon, nitrogen, argon, helium or other ions, but preferably carbon ions, are directed at the mask. The mask metal protects the underlying surface from the ion beam but in the exposed portions of the mask, the high energy ions from the ion beam form electrically conductive non-diamond carbon, if the substrate is diamond. The problem with the use of shadow masking in ion beam implantation for patterning a subtrate is two fold: cartain patterns cannot be performed by this technique and resolution of the pattern done by this technique is poor. The patterns which cannot be done by this technique include the doughnut shapes and resolution of patterns obtained by this technique is generally 20–30 microns, which is poor by today's standards. Resolution generally denotes the smallest feature that can be made.

SUMMARY OF THE INVENTION

An object of this invention is a simple, cheap, selective and clean electrochemical removal of non-diamond carbon from a surface at below or above room temperature.

Another object of this invention is to electrochemically pattern a substrate with non-diamond carbon with high resolution and relatively undamaged exposed surface.

These and other objects of this invention are realized by a process which comprises disposing a surface with a non-diamond carbon layer in an electrolyte and subjecting the surface to sufficient electric field. The selective removal of non-diamond carbon is achieved by the addition of a mask on the non-diamond carbon layer. These and other objects of this invention are also realized by patterned diamond products made by the procedure disclosed herein.

DETAILED DESCRIPTION OF THE INVENTION

Figure 1:
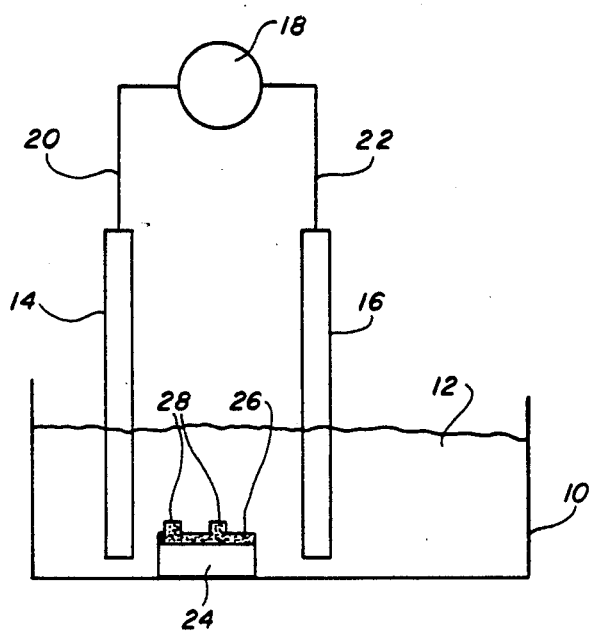
FIG. 1 is a schematic illustration of an electrochemical apparatus.

This invention is directed to the removal of non-diamond carbon disposed on a surface by electrochemical means. This invention is also directed to the patterned substrate product prepared by the procedure disclosed herein.

Removal of non-diamond carbon from a surface can be used to polish and clean the surface. Surprisingly, it can also be applied to patterning a substrate by selectively removing the non-diamond carbon from the surface of a substrate without any direct or physical electrical contact between the substrate and the electrodes.

In accordance with the electrochemical process described herein, a substrate having non-diamond carbon on its surface is immersed on a suitable electrolyte and a voltage is impressed across electrodes to provide a sufficient electric field in the electrolyte near the substrate. The electrodes can be disposed in the electrolyte or they can be disposed outside of it or at least one electrode can be disposed in the electrolyte and at least one electrode can be disposed outside of it. Whether the electrodes are in the electrolyte or outside of it is not important; what is important, for purposes herein, is that the substrate with non-diamond carbon on its surface be subjected to an electric field.

Although the electric field strength required to obtain the optimum removal of non-diamond carbon depends on the particular electrolyte employed, electrode spacing, electrode material and its shape, thickness of the non-diamond carbon to be removed, and other considerations, the electric field in the electrolyte in a practical arrangement will be in the approximate range of 1 to 200 v/cm, preferably 10 to 100 v/cm.

For a small separation of the electrodes, the impressed voltage that can create such an electric field in the electrolyte is in the approximate range of 5 to 5000 volts, preferably 10 to 1000 volts.

Increasing the current does not affect the etch rate. Current in the electrolyte can be increased by adding to the electrolyte a small amount of acid or similar substance.

In an industrial continuous etching operation based on the invention disclosed herein, it would be desired to maintain an etch period as short as possible, preferably on the order of less than 10 minutes, and most preferably in the approximate range of 2 seconds to 1 minute. Bulk etching operation would require longer etch periods on the order of less than 1 hour, preferably in the approximate range of 0.1 minute to 0.5 hour.

In order to pattern a substrate with non-diamond carbon, the non-diamond carbon layer on the substrate is selectively coated or patterned with an appropriate resist material to protect the non-diamond carbon which is to be retained. The thus patterned substrate is then placed in an electrolyte and subjected to an electric field. The electric field acting on the non-diamond carbon disposed on the substrate and immersed in the electrolyte facilitates removal of the non-diamond carbon which is not covered by the resist material. Since the resist material is inert to the electric field and to the electrolyte, it protects the non-diamond carbon that is directly beneath it.

After selective removal of the exposed non-diamond carbon, what is left on the substrate is an outline composed of the resist and the non-diamond carbon directly below the resist. The resist is subsequetly stripped leaving the substrate with a preselected outline of the non-diamond carbon. The pattern has a high resolution and the surfaceof the patterned substrate is relatively undamaged.

A suitable electrolyte for use in the etching apparatus pursuant the invention disclosed herein is a protic, high resistivity liquid. Resistivity of the electrolyte should be between about 100 ohm-centimeters and about 10 megaohm-centimeters, preferably in the approximate range of 20 ohm-cm to 5 megaohm-cm. These liquids contain hydrogen that is attached to oxygen or nitrogen. These protic liquids are to be distinguished from aprotic liquids such as dimethyl sulfoxide, N,N-dimethyl-formamide, and sulfolane, which are polar solvents of moderately high dielectric constants and which do not contain acidic hydrogen.

Especially suitable electrolytes for removal or etching non-diamond carbon include commercially available distilled water; aqueous solutions of acids such as chromic acid and boric acid; aqueous surfactant solutions; aqueous ammonia or ammonium hydroxide; and strong acids such as sulfuric acid. It is preferred to use dilute aqueous electrolyte solutions, i.e., solutions having a current density of about 1 to 100 ma/cm$^2$ (milliamperes per square centimeter) at an impressed voltage of about 50 to 300 volts. An aqueous solution of ammonia or ammonium hydroxide is more difficult to work with than water and concentrated sulfuric acid caused excessive damage to the carbon electrodes.

Etching can be affected by modifying the electrolyte. A more uniform etch can be obtained by bubbling oxygen gas through the electrolyte and adding one or more surfactants to a non-surfactant electrolyte. For example, about 4 to 10 grams of sodium dodecyl sulfate surfactant is dissolved in 100 ml of distilled water and oxygen bubbled through the solution until a foam forms on the electrolyte surface. This is followed by addition of benzylalkonium chloride surfactant until the gas bubbles stop forming on the surface of the electrolyte. Although the surfactant concentrations do nót appear critical, too much benzalkonium chloride surfactant may form a passivating stain on the substrate.

Anionic, nonionic, cationic, and amphoteric surfactants can be used in the present invention. Some examples of anionic surfactants include carboxylic acids and salts, sulfonic acids and salts, sulfuric acid esters and salts, and phosphoric and polyphosphoric acid esters and salts. Some examples of nonionic surfactants include ethoxylated alcohols, ethoxylated alkylphenols, ethoxylated carboxylic esters, and ethoxylated carboxylic amides. Some examples of cationic surfactants include oxygen-free amines, oxygen-containing amines, amide-linked amines, and quaternary ammonium salts.

The container for the electrolyte should be sufficiently large and deep to allow the submersion of a surface to be etched in the electrolyte. Of course, the material of the container should be inert under operating conditions.

The non-diamond carbon is either graphite or amorphous carbon. Graphite is hexagonal carbon and it is crystalline, not amorphous. Whether one or the other is formed depends on the temperature of the diamond substrate during deposition of the amorphous carbon or graphite. If the substrate temperature is elevated during ion beam implantation, then a graphite layer can be formed on the diamond substrate, however, at lower temperatures, amorphous carbon layer is formed. The term non-diamond carbon includes amorphous carbon and graphite. A layer of non-diamond carbon may contain small amounts of other atoms depending on the implanted ions, e.g., nitrogen, argon, helium, iron, and the like.

The substrate can be any material that permits the establishment of a non-diamond carbon layer on its surface. Any means can be used to provide the non-diamond carbon on the surface. If the substrate is diamond, the non-diamond carbon is preferably established on the diamond substrate by ion beam implantation. If the substrate is non-carbon, the non-diamond carbon can be deposited on such a substrate by techniques such as sputtering, vapor deposition or painting.

The non-diamond carbon layer on the substrate typically has a thickness of about 100 to 10,000 angstroms, preferably in the approximate range of 200–5000 angstroms, and most preferably on the order of about 1000 angstroms.

Suitable substrate materials include porcelain-enameled metals, cofired porcelain ceramics, glass, quartz, oxidized-silicon, diamond, sapphire, alumina, beryllia and ferrite. The diamond substrate can be deposited on a support by vapor deposition and implanted with carbon ions to produce a non-diamond layer on a diamond substrate. The preferred substrate is carbon, particularly diamond. Thickness of the presently preferred diamond substrates for electronic applications is in the approximate range of 100 angstroms to 100 mm, preferably 1000 angstroms to 10 mm.

The material of the electrodes can be any conducting material, preferably carbon or a precious metal such as platinum or gold. Of particular interest are electrodes of platinum-iridium wire, platinum gauze, and graphite rods. Graphite and platinum electrodes are most preferred. The electrodes can be in the form of rods, bars, plates, screens, or any other form which can effectively attract ions of opposite charge in an electrolyte and to act as a conveyance means for electrons. Configuration of electrodes, especially cathodes, can affect etching characteristics. The electrodes should be positioned either in the electrolyte or outside of it, at a location such that the substrate is disposed in the path of moving ions in the electrolyte. For this reason and others, some electrodes are in the form of screens or thin plates which increase the path of travel of ions in the electrolyte between the electrodes.

The distance between the electrodes should be sufficient to at least accommodate the substrate(s) and obtain the required electric field strength. Etching rates are controlled by the electric field between the electrodes, increasing with either applied voltage or a decrease in electrode spacing. Spacing between electrodes can be in the approximate range of 0.1 cm to 50 cm, preferably 0.5 cm to 20 cm.

When a portion of the substrate is observed to have been etched, the cathode can be moved to another location closer to another, unetched or lightly etched portion. Also, the substrate can be moved relative to the electrodes in order to obtain the desired or a more uniform etch. If a surface is larger than the width of the electric field, the entire surface can be treated by moving one or both of the electrodes or moving the surface.

Resists that exhibit high resolution, good adhesion to the underlying dielectric layer substrate, good degree of process compatibility, and thickness variations of less than 10 nm, are preffered. The resist thickness contemplated by this invention is from about 1 nm to about 5 microns, preferably from about 10 nm to about 1 micron.

The resists generally fall into two broad classes of positive and negative resists. The resists are radiation-sensitive (low, high or medium energy) thin films. Negative resists become less soluble after exposure through light-induced, electron-induced or other radiation-induced crosslinking. If a small region of a negative resist is exposed, only the exposed region will be covered by the resist after development. Positive resists become more soluble in the developing solvent after exposure, which is caused by a decomposition or a bond scission reaction resulting from photon, electron or other radiation-induced interaction. The positive resists work in the directly opposite way to the negative resists, i.e., if a small region of a positive resist is exposed, only the exposed region will be removed or washed-out after development.

The highest resolution commercially available positive resist is poly(methylmethacrylate) or PMMA. PMMA, however, has a very limited etch resistance which makes it incompatible with many pattern transfer techniques. The reason poly(methylmethacrylate) is a positive resist is because it engages in bond scission when exposed to any exposing medium such as electron beams, x-rays, or deep ultraviolet radiation. Negative resists are attractive for reverse tone patterning and several negative resists are very robust as masks to subsequent etching. However, the highest resolution negative resists do not exhibit resolution as high as that of poly-(methylmethacrylate) positive resist. The poorer resolution of negative resists is believed to be due to post exposure processing required of negative resists. An example of a commercially available, high resolution negative resist is novolac resin. A novolac resin is a phenol formaldehyde plastic of the resole type but formed under acid conditions. Novolaks are fusible and soluble. Other photoresists that can be used herein include waxes, esters and triesters of benzophenone, diazoquinone, polymethyl isopropenyl and phenyl ketone, polyvinylcinnamate, azide-sinsitized resists, azide-insolubilized polyvinylphenols, tetrafunctional acrylate dispersed in PMMA, and the like.

The resist can be applied onto a substrate in any suitable manner including spinning, spraying or dip-coating. The thickness of the resist is about 50 to 1000 nm, preferably about 200 to 600 nm. In ultrahigh resolution work, i.e., sub-hundred nanometers, thin resists are preferred with thickness of less than 200 nm.

The invention herein can be carried out by the electrochemical apparatus shown in FIG. 1. The electrochemical apparatus includes container 10 with electrolyte 12 disposed in the container. Anode 14 and cathode 16 are partially immersed in a spaced relationship in the electrolyte. The anode 14 and cathode 16 are connected to a voltage source 18 by conductors 20 and 22. Substrate 24, disposed between anode 14 and cathode 16, is totally immersed in electrolyte 12. The substrate can also be disposed in the vicinity by the electrodes and not between them as long as it is in the electric field created by the two electrodes. Substrate 24 has on its upper surface a non-diamond carbon layer 26 and photoresist pattern 28 on the non-diamond carbon layer. It should be noted that there is no physical contact between any of the electrodes 14, 16 and the substrate 24, the non-diamond carbon layer 26 or the photoresist pattern 28.

The creation of a non-diamond carbon pattern on a diamond substrate and subsequent selective removal of a non-diamond carbon from the substrate is hereafter described by reference to the apparatus of FIG. 1. Electrolyte 12 is disposed in container 10 to a sufficient depth and electrodes 14,16 are disposed therein. The electrodes in the electrolyte are spaced from each other and only their lower extremities are immersed on the electrolyte. At the upper end, the electrodes are connected to an adjustable voltage source 18 by means of conductors 20, 22.

Diamond substrate 24 is provided with a non-diamond carbon layer 26 by suitable means, such as carbon ion beam implantation using high energy ions. Photoresist pattern 28 is placed on the non-diamond carbon layer and the substrate is immersed in the electrolyte between the electrodes. A voltage is then impressed between the electrodes and etching or selective removal of the exposed non-diamond carbon is allowed to take place. The exposed non-diamond carbon is removed after disintegration and all that is left on the diamond substrate is the resist and the non-diamond carbon directly below the resist. In a subsequent operation after removing the etched substrate from the apparatus of FIG. 1, the resist is stripped off and what remains is a substrate product patterned with non-diamond carbon, with the patterned non-diamond carbon having very high resolution.

The terms "pattern" and "patterning" have meanings that vary from application to application. However, for each area of application, these terms are well-understood by skilled practitioners in the art. For example, in the context of fabricating circuit boards, patterned metallization means laying down conductive pathways on a circuit board, preferably with through-holes and other useful structures. In the context of microelectronic applications, patterned metallization means laying down conductive pathways with linewidths in the sub-0.5 μm range, consistent with VLSI applications. Preferably, in the context of microelectronics, these linewidths are about 0.1 μm, using currently available lithographic techniques. As x-ray lithographic techniques improve, it is anticipated that the present invention will produce microelectronic circuits with linewiths of about 0.05 μm. In the context of lithography, patterning means creating a pattern of lines on a mask with sufficient resolution and packing density for the particular application at hand. In the context of chemical applications (such as chemical sensing) patterned chemical modification means attaching chemical groups in a pattern consistent with the specific application and system at hand.

The following Examples further illustrate this invention, it being understood that the invention is in no way intended to be limited to the details described therein.

EXAMPLE 1

A (100) oriented diamond substrate was implanted with $4\times10^{16}cm^2$ of carbon at 40 KeV. The substrate had dimensions of 4 mm×4 mm×1 mm and was implanted on the 4 mm×4 mm surface. The implanted region i.e., non-carbon layer, was 600 angstroms higher than the virgin or the non-implanted diamond surface before etching. The implanted non-diamond carbon is considered to be a damaged diamond surface which is electrically conducting whereas the diamond surface is non-conducting. Electrodes were graphite rods 0.5 cm in diameter and the electrode spacing was about 2 cm. About 2 cm of each electrode was immersed. The electrolyte was anhydrous ammonium hydroxide and impressed voltage was 60 volts which produced an electric field of about 30 v/cm. Apparatus similar to FIG. 1 was used.

When the implanted diamond substrate was immersed in the electrolyte between the electrodes, significant etching of the implanted non-diamond carbon layer was observed in 1 hour. The completely etched areas on the substrate were 900 angstroms deep. Raman spectra exhibited a gradually increasing diamond peak from the unetched area to the etched pit bottoms and a correspondingly decreasing amorphous carbon signal. Fully etched areas had Raman spectra that was indistinguishable from the virgin surface.

EXAMPLE 2

A (100) oriented diamond substrate was implanted with $4\times10^{16}cm^2$ of carbon at the energy level of 40 KeV. The substrate had dimensions of 4 mm×4 mm×1 mm and was implanted on the 4 mm×4 mm surface. The electrodes were graphite rods 0.5 cm in diameter, electrode spacing was about 2 cm, and lower portion of each electrode was immersed in the electrolyte to the extent of about 2 cm. The electrolyte was distilled water, the impressed voltage was 160 volts, and the etch duration was 1.5 minutes. The electric field in the electrolyte was about 70 v/cm.

Figure 3:
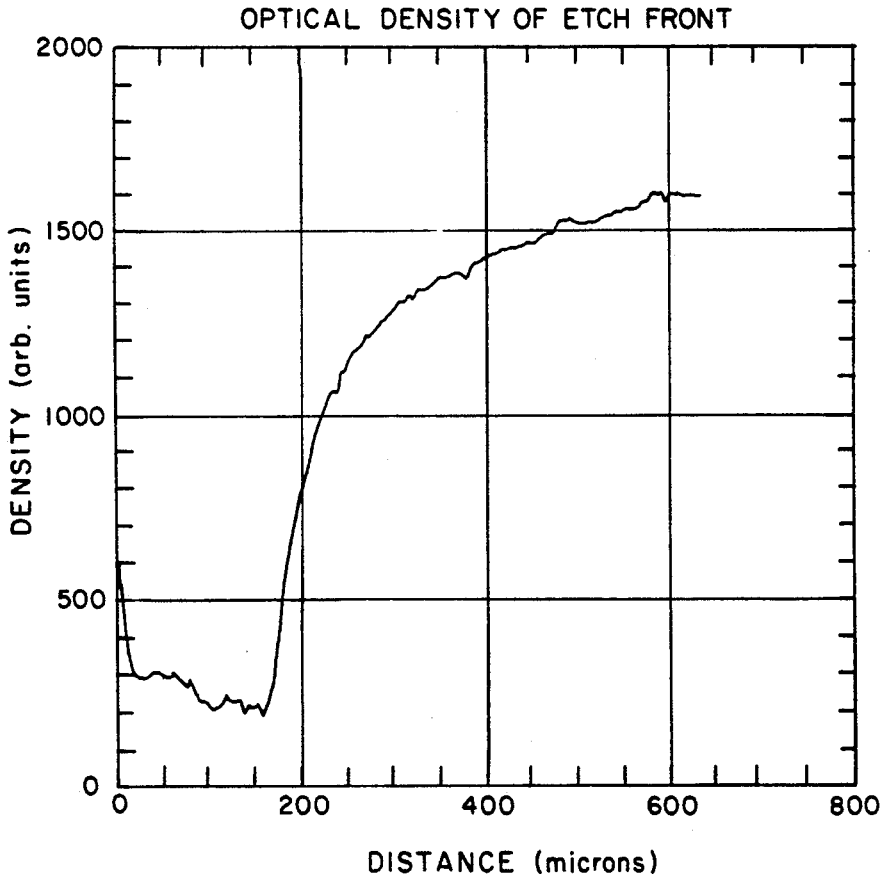
FIG. 3 represents a plot of distance in microns from the edge of the substrate versus optical density in arbitrary units which was obtained using microdensitometer with a 5 micron aperture.
Figure 2:
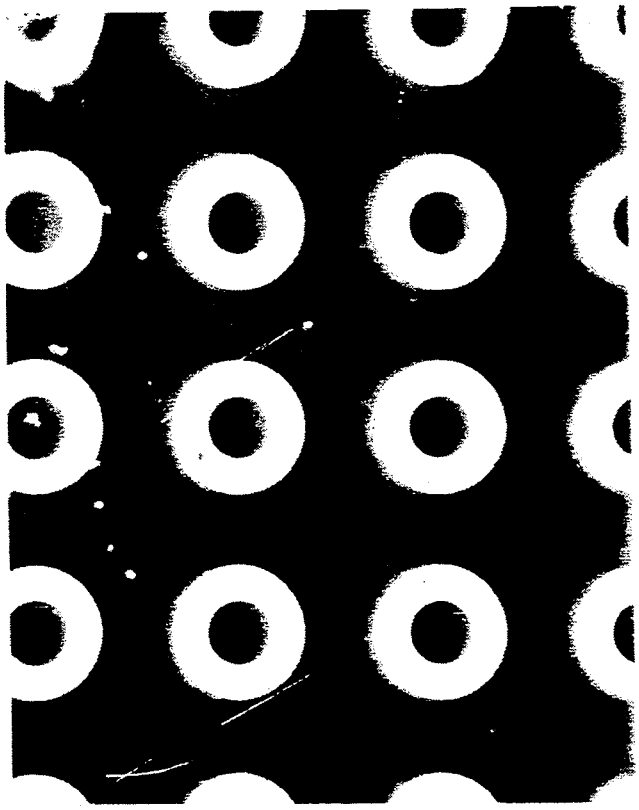
FIG. 2 illustrates the patterning capability of the electrochemical etch described herein showing an etched doughnut structure.

FIG. 3 shows that fully etched area extends from 0 to about 150 microns. The transition to the unetched density occurs over a 400 micron distance. The etch profile shown in FIG. 3 is a plot of distance in microns from the edge of the substrate closest to the cathode versus optical density or log of transmittance for unmasked etch in directional geometry. This demonstrates that a gradual transition can be obtained between etched and non-etched areas on a substrate.

EXAMPLE 3

A (100) oriented diamond substrate was implanted with $4\times10^{16}cm^2$ of carbon at the energy level of 40 KeV. The substrate had dimensions of 4 mm×4 mm×1 mm and was implanted on the 4 mm×4 mm surface. The electrolyte was distilled water, the electrodes were graphite rods 0.5 cm in diameter spaced apart 2 cm with the lower extremity of the electrodes immersed in water to the extent of 2 cm. The impressed voltage was 160 volts and the etch duration was 1.5 minutes. The electric field in the electrolyte was about 50 v/cm. A novolac photoresist, Shipley 1400-26, was patterned to a thickness of 1 micron on the substrate and the ion implanted and patterned substrate was immersed in the electrolyte between the electrodes. After stripping the resist in acetone, a substrate patterned with non-diamond carbon was obtained with a resolution of 1 micron. Apparatus similar to FIG. 1 was used.

EXAMPLE 4

A (100) oriented diamond substrate was implanted with $4\times10^{16}cm^2$ of carbon at the energy level of 40 KeV. The substrate had dimensions of 4 mm×4 mm×1 mm and was implanted on the 4 mm×4 mm surface. The electrolyte was distilled water, the electrodes were graphite rods 0.5 cm in diameter spaced apart 2 cm with the lower extremity of the electrodes immersed in water to the extent of 2 cm. The impressed voltage was 300 volts and the etch duration was 10 minutes. The electric field in the electrolyte was about 100 v/cm. Apparatus similar to FIG. 1 was used.

Before etching, the substrate coated with non-diamond carbon was annealed at 900° C. for 2 hours. All non-diamond carbon was removed during etching. Annealing converted amorphous carbon to graphite.

The invention disclosed herein provides the ability to define patterns of non-diamond carbon on a substrate which allows the fabrication of robust electrical, optical, and mechanical devices. Ion beam implantation, as described herein, causes the insulating substrate to swell, become opaque, and to have a conductive surface of the non-diamond carbon layer.

Selective removal of non-diamond carbon or the damaged diamond surface allows the remaining damaged material to act as a precise spacer layer between the substrate and other objects. High resolution pattern definition allows durable visible light optics and x-ray phase plates to be made. The resistivity of the damaged material is low enough to make it useful as an interconnect material for integrated circuits. This demonstrates that the etched surface is relatively undamaged and is of relatively high resistivity. Controlled reduction of the layer thickness makes it possible to fabricate semi-transparent electrodes for opto-electronic devices.

It should be recognized that the foregoing description and discussion are merely meant to illustrate the principles of the instant invention and not meant to be a limitation upon the practice thereof. It is the folowing claims, including all equivalents, which are meant to define the true scope of the instant invention.

What is claimed is:

1. A process for the removal of non-diamond carbon from a surface on a substrate comprising the steps of submerging the surface in a protic electrolyte having a resistivity from about 100 ohm-centimeters to about 10 megaohm-centimeters and subjecting the surface to an electric field of sufficient strength to remove the non-diamond carbon.

2. The process of claim 1 wherein the electromotive force produces an electric field in the electrolyte which is in the range of about 1–200 v/cm.

3. The process of claim 2 wherein the electric field in the electrolyte is in the approximate range of 10 to 100 v/cm. hour.

4. A process for selectively removing non-diamond carbon from a surface comprising the steps of selectively coating the non-diamond carbon disposed on the surface with a resist to provide a region of exposed non-diamond carbon and a region of unexposed non-diamond carbon, submerging the surface in an electrolyte, and subjecting the surface to an electric field of sufficient strength to remove non-diamond carbon.

5. The process of claim 4 wherein the surface is carbon and the electric field is 1–200 v/cm.

6. The process of claim 5 wherein the surface is diamond and the electric field is in the approximate range of 10–100 v/cm.

7. The process of claim 6 wherein the electrolyte is selected from the group consisting of water, acid, aqueous ammonia, ammonium hydroxide, aqueous surfactant solutions, and mixtures thereof.

8. The process of claim 6 wherein the electrolyte is water.

9. The process of claim 6 wherein the electrolyte is water, the resist contains novolac resin, the non-diamond carbon is graphite, and thickness of the non-diamond carbon layer is in the approximate range of 100–10,000 angstroms.

10. The process of claim 9 wherein the electrolyte is distilled water; the thickness of the non-diamond carbon layer is on the order of about 1000 angstroms; the electrodes are made of graphite; and the surface is disposed between the electrodes and is not in physical contact with the electrodes.

11. A patterned substrate made by the process of claim 3 having resolution of about 1 micron.

12. A substrate made by the process of claim 9.

13. A process for patterning a diamond substrate having a non-diamond carbon layer thereon comprising the steps of selectively coating the non-diamond carbon with a resist to provide exposed and unexposed non-diamond carbon on the substrate, submerging the non-diamond carbon in an electrolyte, and impressing a voltage on at least that portion of the electrolyte which contains the non-diamond carbon, said impressed voltage being sufficiently great to create an electric field which removes essentially all exposed non-diamond carbon from the substrate.

14. The process of claim 13 wherein the electric field is in the range of about 1–200 v/cm.

15. The process of claim 14 wherein the electric field is in the approximate range of 10–100 v/cm.

16. The process of claim 14 wherein the electrolyte has resistivity in the approximate range of 100 ohm-cm to 10 megaohm-cm.

17. The process of claim 16 wherein electrodes are disposed in the electrolyte and voltage impressed between the electrodes is in the approximate range of 100–1000 volts.

18. The process of claim 17 wherein the non-diamond carbon is graphite and its thickness is about 100–10,000 angstroms; the spacing between the electrodes is about 0.5–20 cm; and the electrolyte is selected from the group consisting of water, acids, aqueous ammonia, ammonium hydroxide, surfactant solutions, and mixtures thereof.

19. A patterned substrate made by the process of claim 17 having resolution of about 1 micron and having a relatively undamaged surface.

20. A substrate made by the process of claim 18.

* * * * *